US010077590B2

(12) United States Patent
Faccone

(10) Patent No.: US 10,077,590 B2
(45) Date of Patent: Sep. 18, 2018

(54) GARAGE DOOR VENTING SYSTEM AND METHOD

(71) Applicant: Keith Edward Faccone, Marco Island, FL (US)

(72) Inventor: Keith Edward Faccone, Marco Island, FL (US)

( * ) Notice: Subject to any disclaimer, the term of this patent is extended or adjusted under 35 U.S.C. 154(b) by 0 days.

(21) Appl. No.: 14/601,637

(22) Filed: Jan. 21, 2015

(65) Prior Publication Data

US 2015/0204135 A1 Jul. 23, 2015

Related U.S. Application Data

(60) Provisional application No. 61/930,629, filed on Jan. 23, 2014.

(51) Int. Cl.

| | |
|---|---|
| ***E05D 15/24*** | (2006.01) |
| ***E05F 15/00*** | (2015.01) |
| ***E06B 3/48*** | (2006.01) |
| ***E06B 7/06*** | (2006.01) |
| *E06B 3/70* | (2006.01) |

(52) U.S. Cl.

CPC ..... *E05F 15/00* (2013.01); *E05D 15/248* (2013.01); *E06B 3/485* (2013.01); *E06B 7/06* (2013.01); *E05D 15/24* (2013.01); *E05Y 2900/106* (2013.01); *E06B 2003/7044* (2013.01)

(58) Field of Classification Search

CPC ..... E05D 15/24; E05D 15/248; E05D 15/583; E05F 15/668; E06B 7/06; E06B 7/04; E06B 3/485; E06B 2003/7044

See application file for complete search history.

(56) References Cited

U.S. PATENT DOCUMENTS

| | | | | | |
|---|---|---|---|---|---|
| 2,453,554 | A * | 11/1948 | Thomas | E05D 15/248 | 160/201 |
| 2,573,962 | A * | 11/1951 | Fox | E05D 15/246 | 16/95 R |
| 2,625,221 | A * | 1/1953 | McKee | E05D 15/244 | 16/91 |
| 4,018,005 | A * | 4/1977 | Harris | E05F 15/673 | 160/188 |
| 4,537,237 | A * | 8/1985 | Sepulveda | E05D 15/24 | 160/116 |
| 5,846,127 | A | 12/1998 | Kile | | |
| 8,327,907 | B2 * | 12/2012 | Hoermann | E05D 15/246 | 160/201 |
| 2012/0222278 | A1 * | 9/2012 | Verdier | F16B 1/0071 | 29/407.1 |

FOREIGN PATENT DOCUMENTS

| | | | | |
|---|---|---|---|---|
| DE | 10238627 B4 * | 3/2005 | ..... | E05D 15/248 |
| EP | 1724426 A2 | 5/2006 | | |

* cited by examiner

*Primary Examiner* — Katherine W Mitchell
*Assistant Examiner* — Abe L Massad
(74) *Attorney, Agent, or Firm* — Maine Cernota & Rardin

(57) ABSTRACT

A ventilation system for sectional-type garage doors, utilizing rollers and axle pins with device bodies of adjustable geometry to hold the upper section of the sectional door at an inwardly-rotated angle to facilitate venting of the space. Component installation and operation does not impact normal operation and is completely reversible, requiring no modifications to the door itself.

15 Claims, 23 Drawing Sheets

SYSTEM ENVIRONMENT

SYSTEM ENVIRONMENT

DEVICE INSTALLATION OVERVIEW RIGHT SIDE IN CLOSED POSITION

DEVICE OPERATION OVERVIEW

DEVICE OPERATION ROTATION GEOMETRY DETAILS

ADJUSTABLE ROLLER DEVICE EMBODIMENT 1 PERSPECTIVE VIEW

600

ADJUSTABLE ROLLER DEVICE EMBODIMENT 1 EXPLODED VIEW

700

ADJUSTABLE ROLLER DEVICE EMBODIMENT 1 SIDE VIEW

ADJUSTABLE ROLLER DEVICE EMBODIMENT 1 SIDE EDGE VIEW

ADJUSTABLE ROLLER DEVICE EMBODIMENT 1 BOTTOM UP VIEW

ADJUSTABLE L-BAR EMBODIMENT 1 PERSPECTIVE VIEW

1100

ADJUSTABLE L-BAR EMBODIMENT 1 EXPLODED VIEW

ADJUSTABLE L-BAR EMBODIMENT 1 SIDE VIEW

ADJUSTABLE L-BAR EMBODIMENT 1 SIDE EDGE VIEW

ADJUSTABLE L-BAR EMBODIMENT 1 BOTTOM UP VIEW

ADJUSTABLE ROLLER DEVICE EMBODIMENT 2 PERSPECTIVE VIEW

ADJUSTABLE ROLLER DEVICE EMBODIMENT 2 PERSPECTIVE VIEW CLOSED POSITION

ADJUSTABLE ROLLER DEVICE EMBODIMENT 2 PERSPECTIVE VIEW OPEN POSITION

1800

ADJUSTABLE L-BAR EMBODIMENT 2 PERSPECTIVE VIEW

1900

ADJUSTABLE L-LINK EMBODIMENT 2 DOOR RAISED, OPEN POSITION

2000

ADJUSTABLE ROLLER DEVICES AND L-LINK EMBODIMENT 2

ADJUSTABLE ROLLER DEVICE EMBODIMENT 3 PERSPECTIVE VIEW CLOSED POSITION

2200

ADJUSTABLE ROLLER DEVICE EMBODIMENT 3 PERSPECTIVE VIEW OPEN POSITION

METHOD FLOW CHART

GARAGE DOOR VENTING SYSTEM AND METHOD

RELATED APPLICATION

This application claims the benefit of U.S. Provisional Application No. 61/930,629 filed Jan. 23, 2014, incorporated herein by reference in its entirety for all purposes.

FIELD OF THE INVENTION

The invention relates to a garage door venting system and method for retrofitting a sectional garage door with a roller and axel pin device of adjustable geometry to cause it to rotate inwardly at the top through a simple geometry.

BACKGROUND OF THE INVENTION

Especially in hot climates, garage temperatures rise significantly when doors are closed. Fumes from parked vehicles and stored volatile compounds can accumulate in unvented spaces. Both of these can cause significant problems for living quarters above garages. It is common practice to vent garages by partially opening the doors, leaving a gap under the unlocked door's bottom section. However, this may not result in adequate venting, and it poses numerous other issues such as rodent infestation, lack of security, flooding, entrance of blowing debris, etc. While venting solutions may be available (i.e. fans and screens that may be installed in any type of garage door), they require irreversible modifications to the door itself and may not be easily installable by someone unskilled in the trade.

Some existing devices open a top door panel, but they are not variable; they are either fully closed or fully open. They must be adjusted to the door frame. There are no provisions for attaching to a common automatic garage door opener. They require new holes to be drilled in the door. The differences in modern garage door designs (solid wood, hollow fiberglass, plastic, metal) require different structural solutions for these holes. Required new brackets are specific to the door installation, and do not work with some garage doors.

Further, the garage door environment is often dirty and humid, and door components can become covered with grime and corrosion. This can be a serious impediment to moving parts. Dirty hinges and other rotating components can bind, preventing movement of the door and triggering safety mechanisms. The more complex the rotation, the more susceptible the rotating component will be to binding.

What is needed is a simple, single-arc rotation universal, variable setting, adjustable, retrofit system easily installed and reversible that overcomes these and other problems.

SUMMARY OF THE INVENTION

Embodiments provide a system of rollers, axle pins, and adjustable geometry device bodies for providing ventilation to an interior volume at least partially enclosed by a horizontally sectioned, vertically openable door comprising a pair of replacement rollers, axle pins, and adjustable geometry device bodies installed in a pair of original roller brackets of a top door section of the sectioned door, the pair of original roller brackets located at opposite ends of the top door section; at least one of the replacement adjustable geometry device bodies comprising a rotation stop mechanism; and, for automatically openable doors, an adjustable L-link device affixed to an original door opener bar link; whereby the top door section is rotatable inward.

Other embodiments of the invention include a door vent device for venting a space having at least one opening closed by a horizontally sectioned, vertically openable door, the door comprising a top section hingedly connected to lower sections, the vent device comprising at least two adjustable roller device top fixtures; each of the adjustable roller device top fixtures comprising a replacement axle pin for insertion in a standard top bracket of the door top section; a pair of replacement rollers; a body plate; a rotating arm plate, and a rotation stop mechanism; whereby the door top section is rotatable inward. Another embodiment includes an adjustable L-link device affixed to an original door arm bracket. Additional embodiments further comprise at least one rotation stop mechanism knob. Other embodiments have a locking spring-loaded plunger. In a yet further embodiment, the width of the plates of the adjustable geometry device body is less than a horizontal separation between a door-side edge of the track and a track-side edge of nearest the standard door top bracket. For some embodiments, the horizontal separation is about one half inch. In other embodiments, the body plate defines a rotation arc. In embodiments, the rotation arc is at least similar to an arc defined by a rotation radius of the door top section. For a following embodiment, the rotation arc is defined by a radius from center of the lower roller of the door top section. For further embodiments the radius of the rotation arc is centered at a pivot of the rotating arm plate. In existing embodiments, the adjustable L-link device connects to a center automatic door opener. A subsequent embodiment provides that the door can be opened and closed by the automatic door opener with door top at any venting position. Another embodiment includes at least one swage fit stud. Yet another embodiment includes at least one swage fit bolt.

Another embodiment provides a door vent method for venting a space having at least one opening closed by a horizontally sectioned, vertically openable door, the door comprising a top section hingedly connected to lower sections comprising the steps of removing door upper section top bracket; removing roller from standard top bracket; inserting adjustable roller device into track; placing standard top bracket onto adjustable roller device roller pin; reaffixing standard top bracket to door upper section; repeating preceding steps for opposite side; determining door top opening angle; adjusting a first adjustable roller bracket for door opening angle; adjusting a second adjustable roller bracket for door opening angle. Continuing embodiments comprise the steps of disconnecting a standard center bar from door; and connecting an adjustable L-link between door center and door raising hardware. Another embodiment adds the step of adjusting the center L-link for door vent opening angle. Other embodiments include the step of automatically or manually raising the door with door top at any angle provided by the adjustable roller devices and the adjustable L-link. Yet other embodiments include the step of automatically or manually closing the door with door top at any angle provided by the adjustable roller devices and the adjustable L-link.

An additional embodiment provides a door vent system for venting a space having at least one opening closed by a horizontally sectioned, vertically openable door, the door comprising a top section hingedly connected to lower sections comprising providing a vent device comprising at least two adjustable roller device top fixtures; each of the adjustable roller device top fixtures comprising a replacement axle pin for insertion in a standard top bracket of the door top section; a pair of replacement rollers; a body plate; a rotating arm plate; a rotation stop mechanism; removing door upper section top bracket; removing roller from standard top bracket; inserting adjustable roller device into track; placing standard top bracket onto adjustable roller device roller pin; reaffixing standard top bracket to door upper section; repeating preceding steps for opposite side; disconnecting standard center bar from door; connecting adjustable L-link between door center and door raising hardware; determining door top opening angle; adjusting a first adjustable roller bracket for door opening angle; adjusting a second adjustable roller bracket for door opening angle; adjust center L-link for door opening angle; optionally automatically or manually raise door with door top at any angle provided by adjustable roller devices and adjustable L-link; optionally automatically or manually close door with door top at any angle provided by adjustable roller devices and adjustable L-link.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The invention includes rollers and axle pins with attached device bodies providing adjustable geometry. Embodiments are adjustable to any point between open and closed positions. Embodiments automatically adjust to the garage door by the structure of the design. Since embodiments replace the roller and pin which are universal to all garage door installations, no specific adjustments need to be made. Embodiments comprise an adjustable L-link for attaching to an automatic garage door opener. Since embodiments replace the existing roller and pin, they are flexible by virtue of their structure. Embodiments work with any existing bracket and roller track, whereas garage door brackets accept the same size pin, garage door tracks accept the same size rollers, and only the pin and roller are replaced. Embodiments operate with low head room hardware and do not interfere with track back hang assemblies. Manually opened doors without electrical operation do not require replacement of the L-link.

PEM® is a brand of swage studs, pins or nuts that, when pressed into ductile metal, are prevented from rotating in the metal. PEM® is a registered trademark of the Penn Engineering & Manufacturing Corp.

Figure 1:
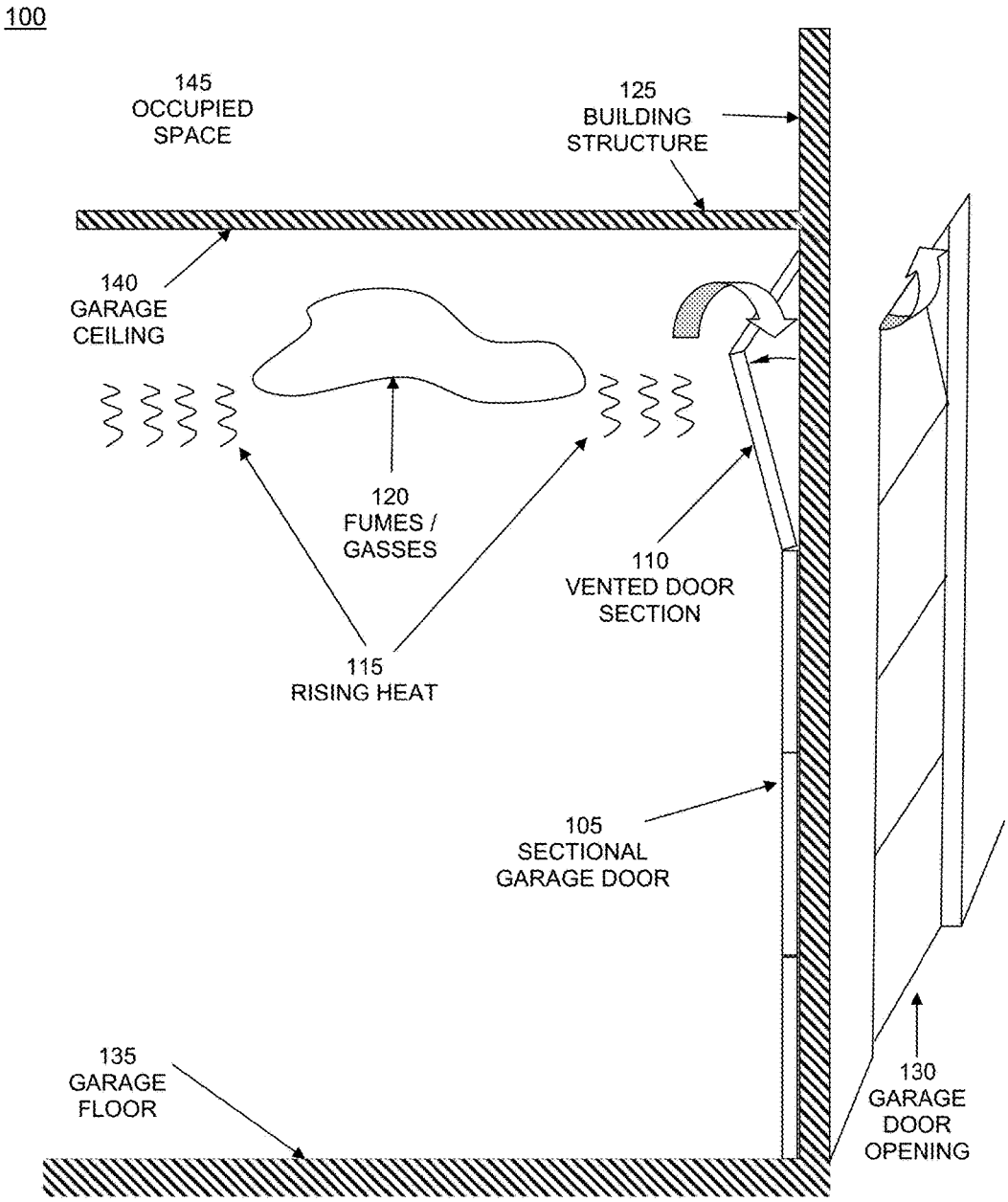
FIG. 1 is a depiction of the system environment configured in accordance with an embodiment.

FIG. 1 is a depiction of the system environment 100. Sectional garage door 105 includes open, venting, top section 110 for venting rising heat 115 and fumes and gasses 120. Building structure 125 includes garage door opening 130, garage floor 135, garage ceiling 140, and occupied space 145 above the garage.

Figure 2:
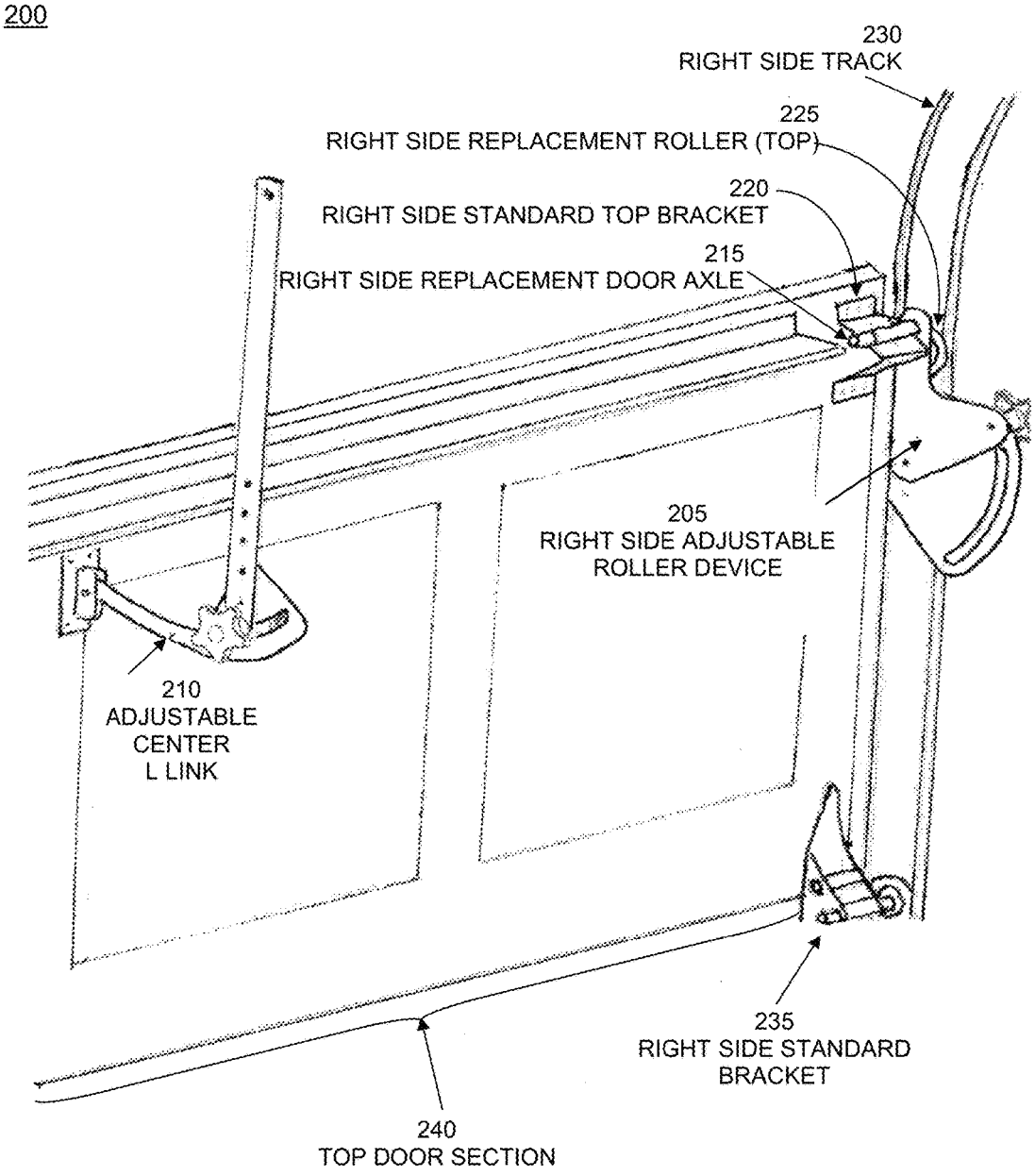
FIG. 2 is a perspective view of an installed vent system in a closed position configured in accordance with an embodiment.

FIG. 2 is a perspective view of the right side of an installed vent system embodiment 200 in a closed position. System components comprise right side adjustable roller device top fixture 205 and adjustable center L-link device 210. Right side replacement door axle 215 is shown in standard top bracket 220. Right side replacement top roller 225 is attached to right side adjustable roller device top fixture 205, and runs in standard right side track 230. Below right side adjustable roller device top fixture 205 is right side (lower) standard roller and bracket 235 for top door section 240.

Figure 3:
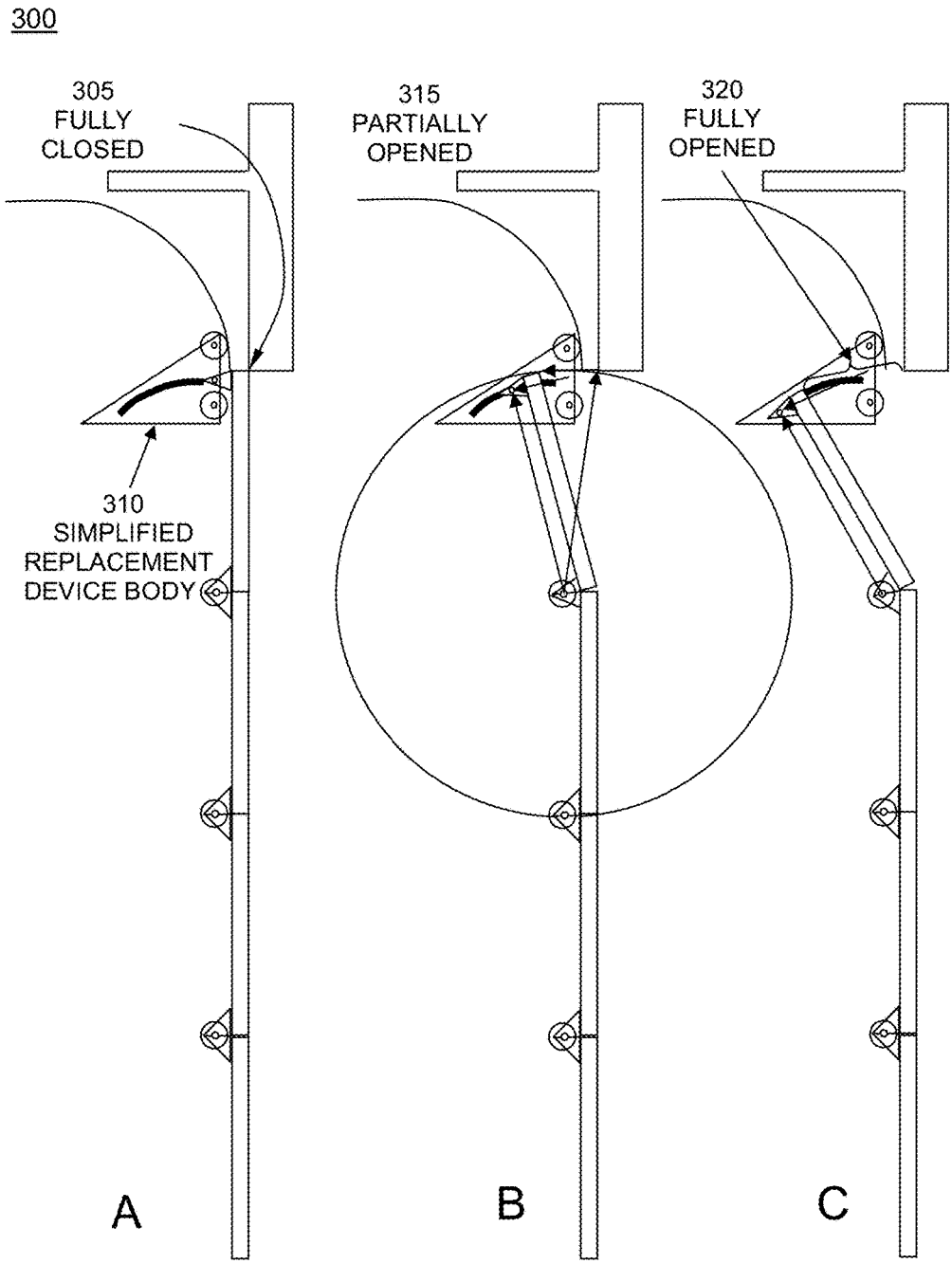
FIG. 3 is a depiction of a device operation overview configured in accordance with an embodiment.

FIG. 3 is a depiction of a device embodiment overview 300. Three positions, fully closed A, partially open B, and fully open C are shown. Fully closed position 305 depicts a simplified double-roller device 310 affixed to the top bracket, replacing its roller and pin. Partially opened position 315, B, indicates radius and arcs of rotation for the top bracket component in relation to the replacement roller device components. Fully opened position 320, C, shows the roller device at its maximum travel, and therefore the top door section maximum open position.

Figure 4:
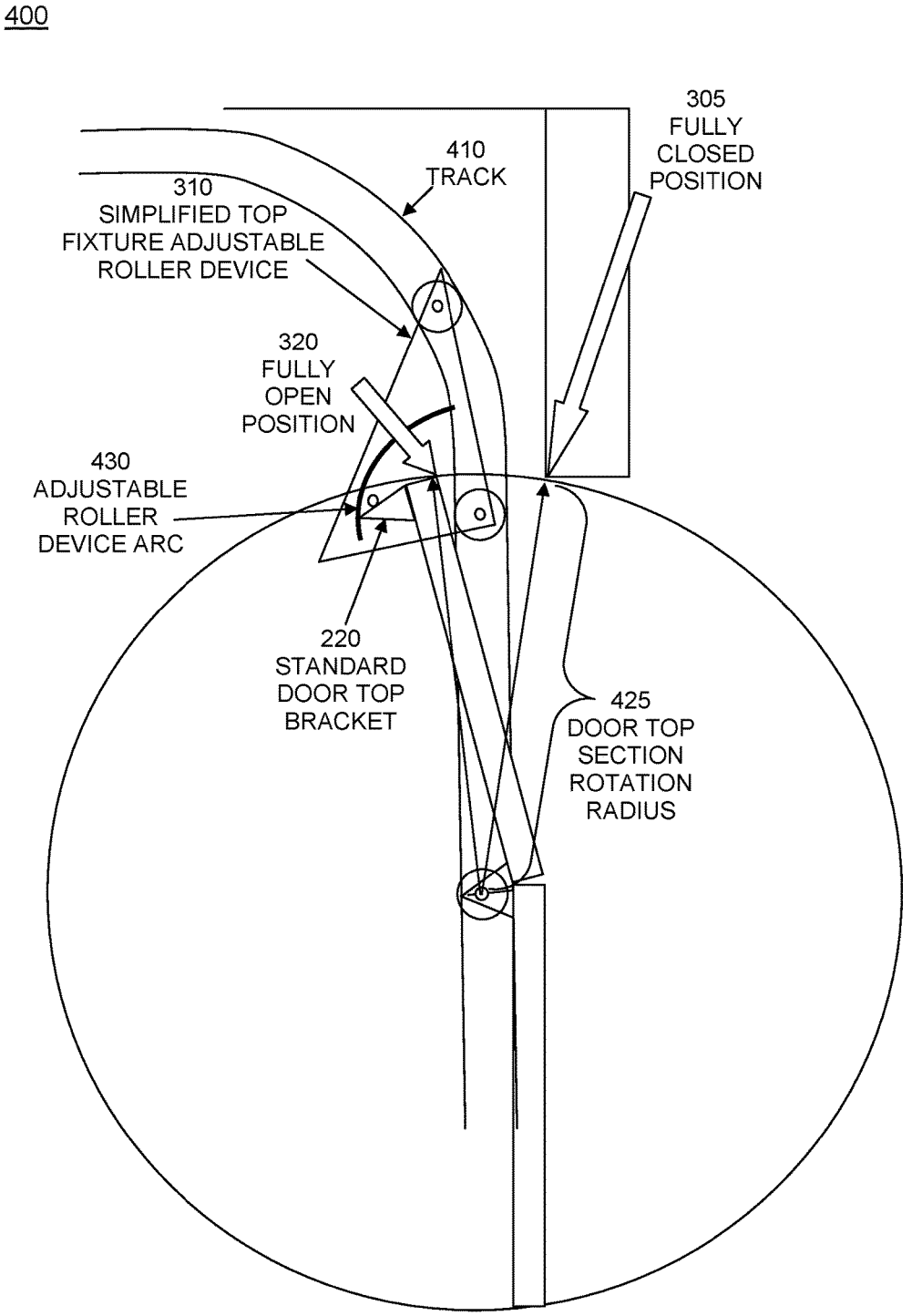
FIG. 4 depicts device operation rotation geometry details configured in accordance with an embodiment.

FIG. 4 depicts device operation rotation geometry details 400. Simplified top fixture adjustable bracket 310 is shown in track 410. Fully closed 415 and fully open 420 positions are depicted. Door top section has a rotation radius 425 from the center of the upper door section lower roller center. Adjustable roller device has an arc 430. For embodiments, the adjustable roller arc curvature is at least similar to the arc defined by the door top section rotation radius. This can reduce binding of rollers as the door top section rotates to an open position. Standard top bracket 220 is used by adjustable roller device to control opening position of door top section.

Figure 5:
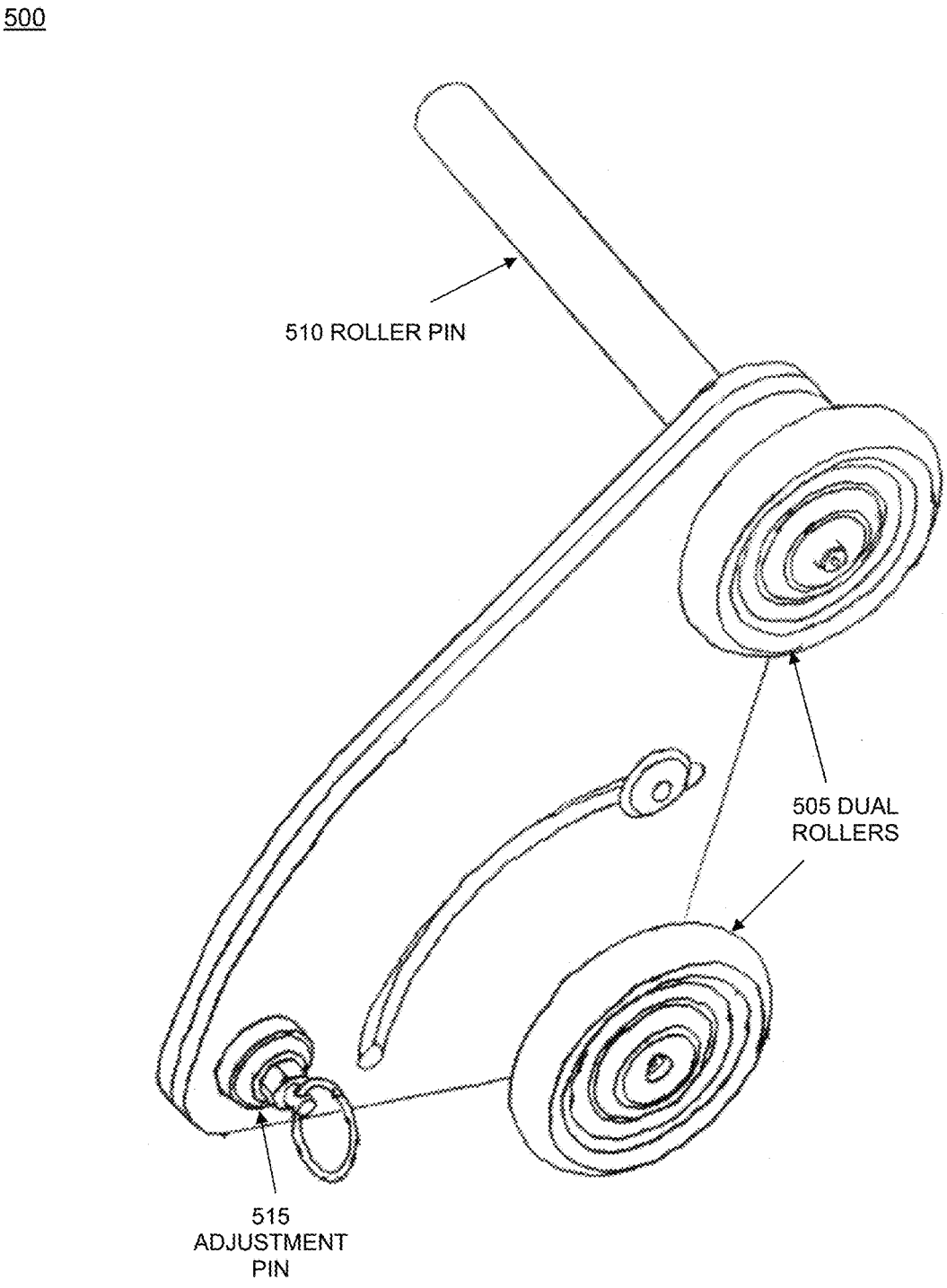
FIG. 5 is a perspective scale drawing of a top fixture adjustable roller device configured in accordance with an embodiment.

FIG. 5 is a perspective drawing of a top fixture adjustable roller device first embodiment 500. Components comprise dual rollers 505, roller pin 510, and adjustment pin 515.

Figure 6:
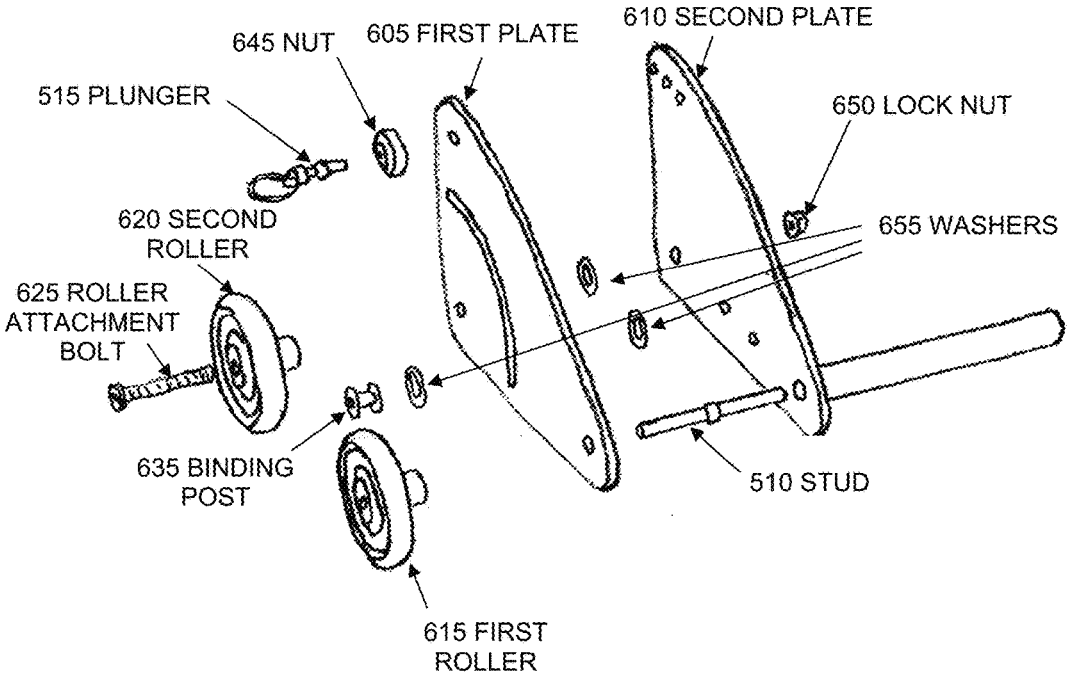
FIG. 6 is an adjustable roller device exploded view configured in accordance with an embodiment.

FIG. 6 is a top fixture adjustable roller device first embodiment exploded view 600. Components comprise first flat plate 605, second flat plate 610; first roller 615, second roller 620, roller attachment bolt 625, PEM® self-clinching threaded stud 510, steel binding post 635, locking spring-loaded plunger 515, PEM® self-clinching threaded nut 645, lock nut 650, and nylon washers 655. For embodiments, each assembly comprises two steel plates. Embodiments of the plates are made of ASTM A36 steel plate, a low carbon steel that exhibits good strength coupled with formability. It is easy to machine and fabricate and can be securely welded. The steel can be galvanized or powder coated to provide increased corrosion resistance. This structure provides a clean, anti-friction device to operate reliably in dirty environments. These plates pivot to allow the device to adjust, and, in embodiments, are held together by a PEM® threaded swage stud. Embodiments have adjustment holes 100, 90, 80, 45, and 0 degrees. As mentioned, the rollers and shaft are standard off the shelf rollers that work properly with existing garage door track systems. In embodiments, these rollers are attached to the plates using a PEM® threaded swage stud. Adjustment for embodiments uses a spring loaded plunger that is threaded into a PEM® nut. When the ring on the pin is pulled, the pin is disengaged from the corresponding hole in the second plate allowing the two plates to pivot.

Figure 7:
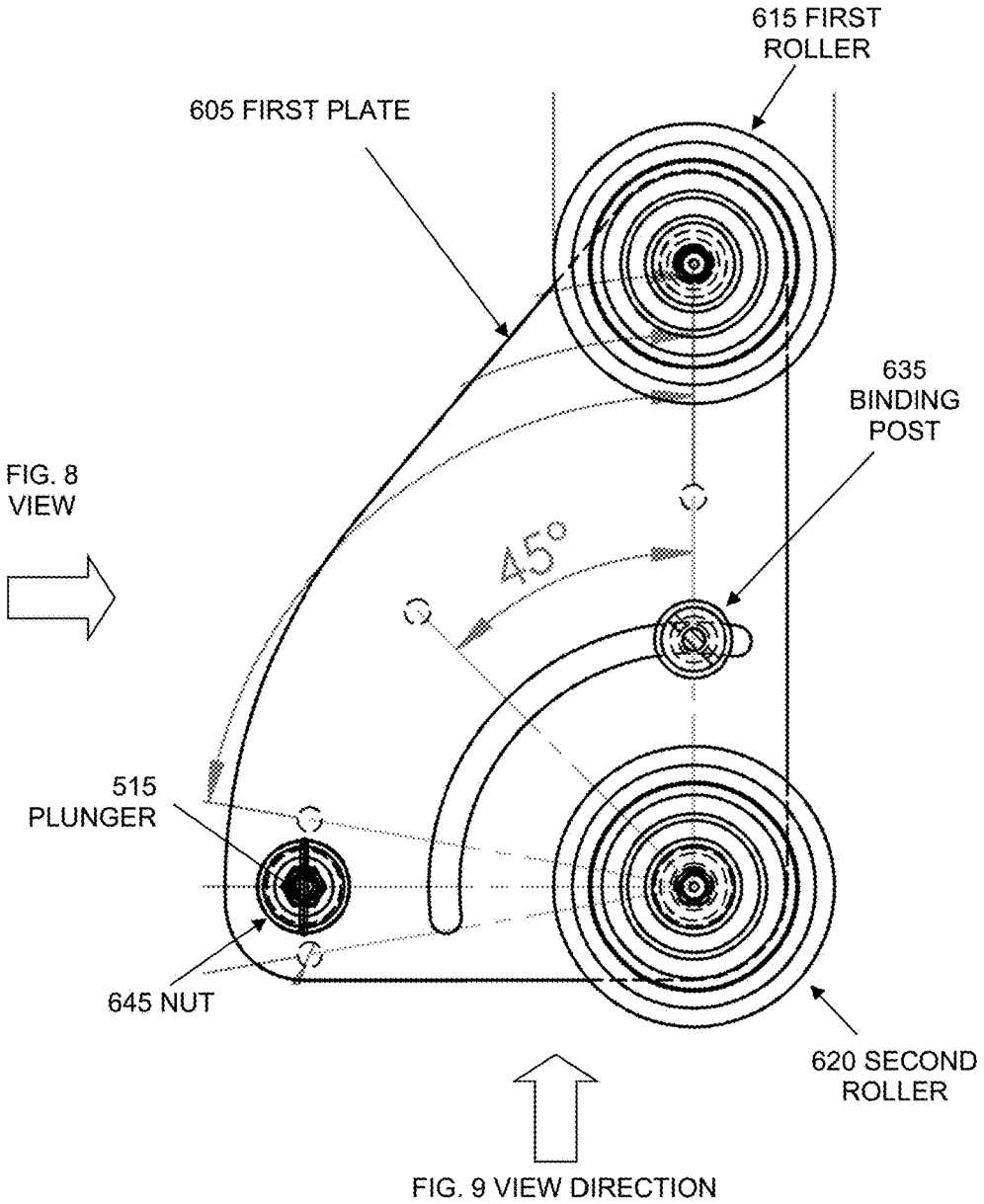
FIG. 7 is a top fixture adjustable roller device scale side view configured in accordance with an embodiment.

FIG. 7 is a top fixture adjustable roller device first embodiment side scale view 700. Components comprise first flat plate 605, first roller 615, second roller 620, binding post 635, locking spring-loaded plunger 515, and PEM® self-clinching threaded nut 645.

Figure 8:
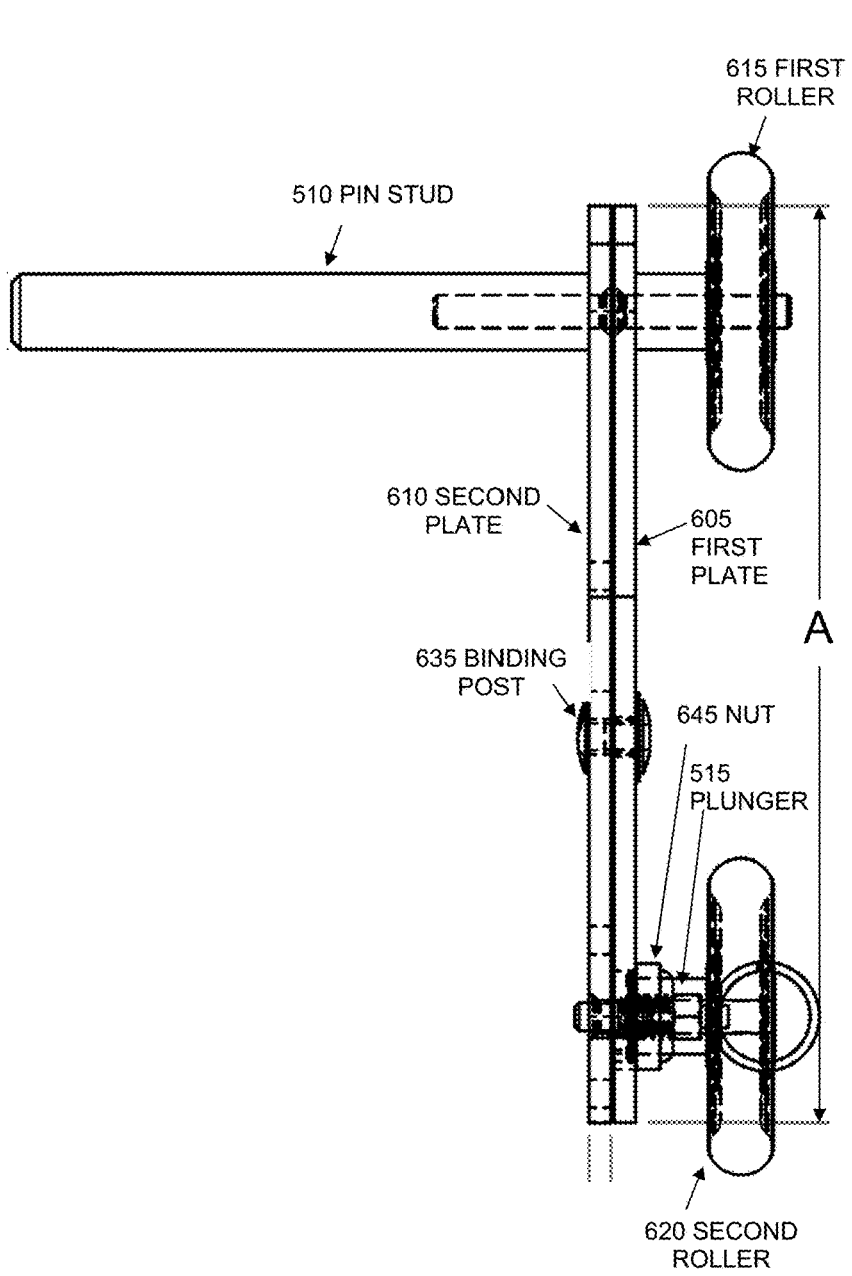
FIG. 8 is a top fixture adjustable roller device scale side edge view configured in accordance with an embodiment.

FIG. 8 is a top fixture adjustable roller device first embodiment side edge scale view 800. Dimension A is 5.20 inches in embodiments. Components comprise first flat plate 605, second flat plate 610; first roller 615, second roller 620, PEM® self-clinching threaded roller pin stud 510, steel binding post 635, locking spring-loaded plunger 515, and PEM® self-clinching threaded nut 645.

Figure 9:
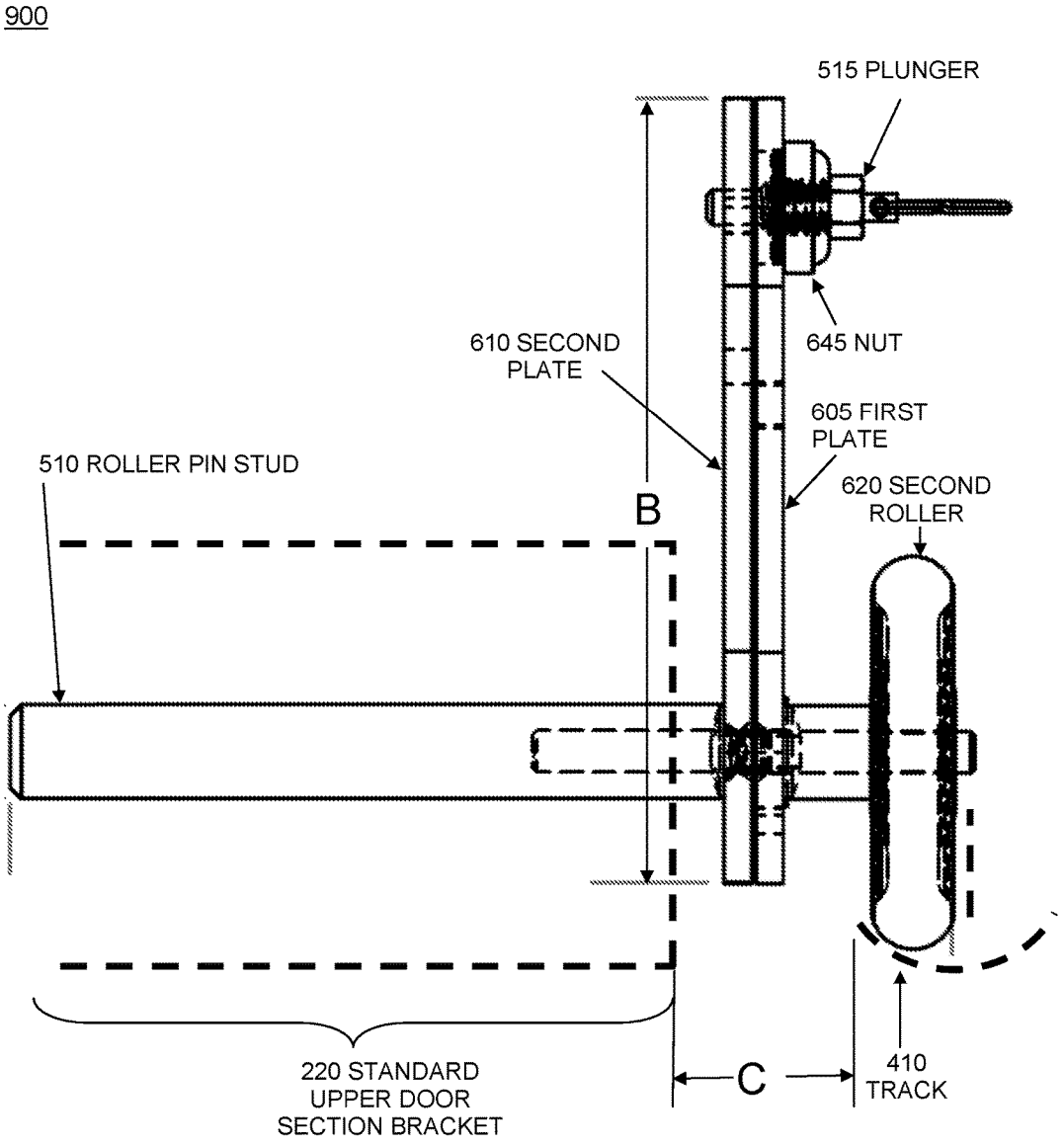
FIG. 9 is a top fixture adjustable roller device bottom up scale view configured in accordance with an embodiment.

FIG. 9 is a top fixture adjustable roller device first embodiment bottom up scale view 900. Dimension B is 3.60 inches in embodiments. Dimension C is the gap between the original top bracket 220 for the top door section and the near edge of the track 965; it is about 0.25 to about 0.5 inch in embodiments. In embodiments, at least first plate 605 and second plate 610 fit entirely within this gap. Components comprise first flat plate 605, second flat plate 610; second roller 620, PEM® self-clinching threaded roller pin stud 510, locking spring-loaded plunger 515, and PEM® self-clinching threaded nut 645.

Figure 10:
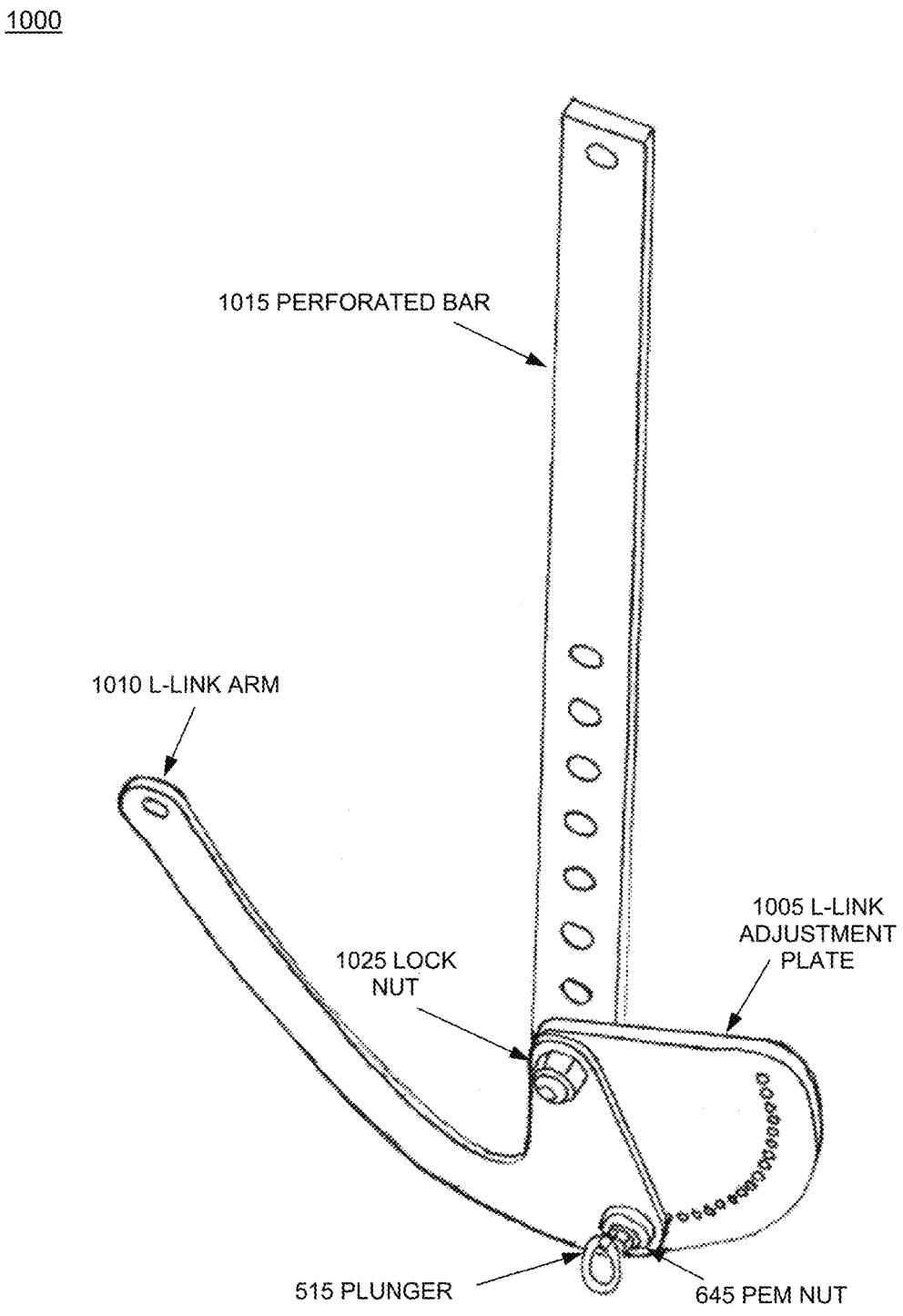
FIG. 10 is an adjustable L-link device perspective view configured in accordance with an embodiment.

FIG. 10 is a perspective view of an adjustable L-link device first embodiment 1000. Components comprise L-link adjustment plate 1005, L-link arm 1010, perforated bar 1015, first lock nut 1025, PEM® self-clinching threaded nut 645, and locking spring loaded plunger 515.

Figure 11:
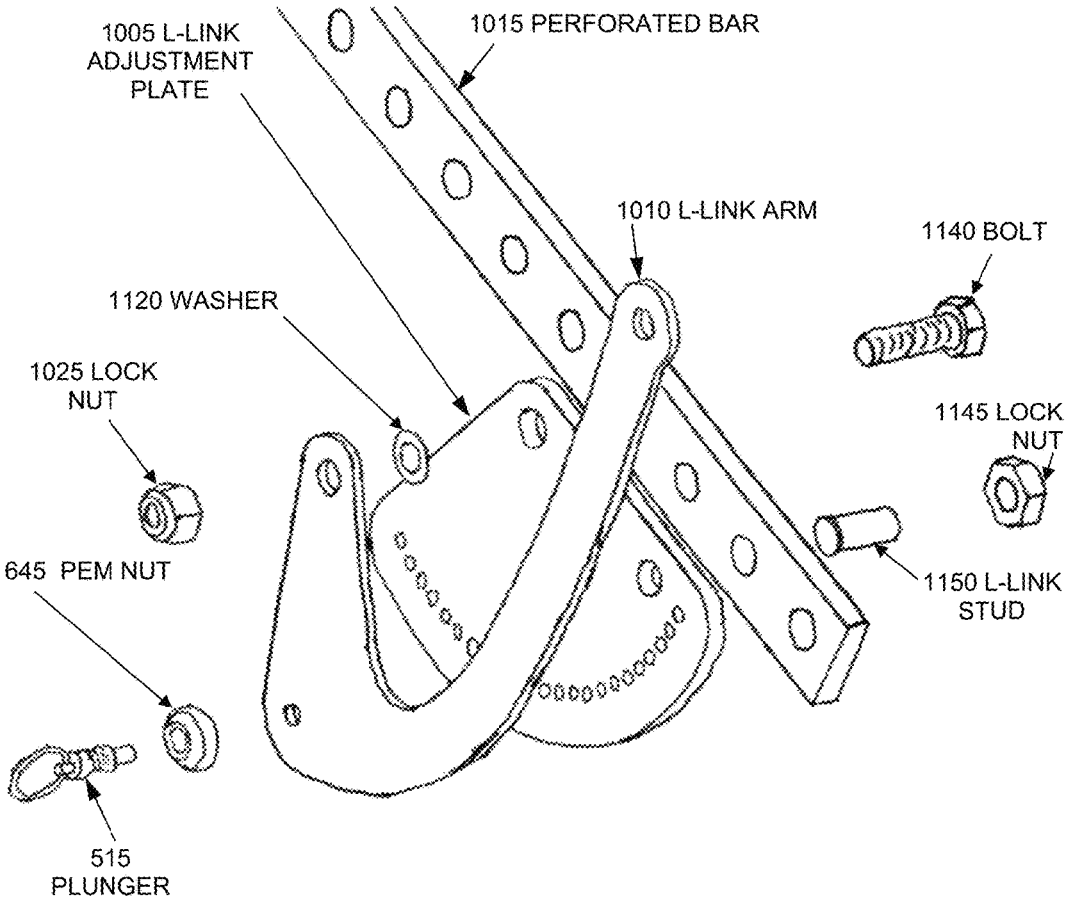
FIG. 11 is an adjustable L-link device exploded view configured in accordance with an embodiment.

FIG. 11 is an adjustable L-link device exploded view first embodiment 1100. Components comprise L-link adjustment plate 1005, L-link arm 1010, perforated bar 1015, nylon washer 1120, first lock nut 1025, PEM® self-clinching threaded nut 645, locking spring loaded plunger 515, standard bolt 1140, second lock nut 1145, and PEM® self-clinching threaded stud 1150. The adjustable L-link device mounts in the center of the top garage door panel where the automatic opener connects. In embodiments, this device consists of two powder coated steel plates that are connected with a bolt and lock nut. Generally, embodiments for device plates are formed using sheet steel metal stamping to provide narrow, reliable, components at an inexpensive price. Embodiments use the same spring plunger and PEM® nut as the adjustable roller device, and have 110 degrees of adjustment with locking locations every 5 degrees.

Figure 12:
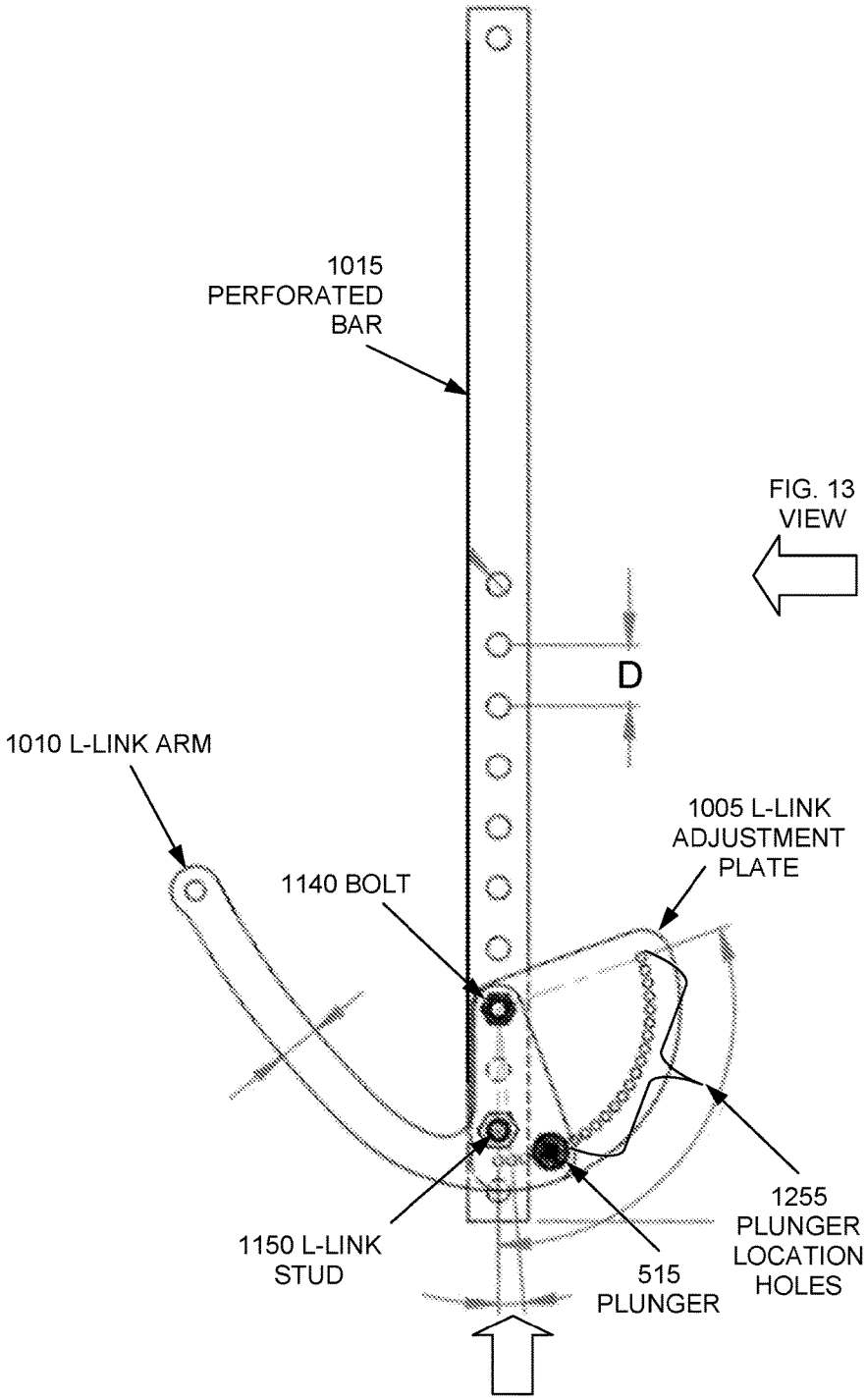
FIG. 12 is an adjustable L-link device scale side view configured in accordance with an embodiment.

FIG. 12 is an adjustable L-link device first embodiment side scale view 1200. Dimension D is 1.00 inches in embodiments. Components comprise L-link adjustment plate 1005, L-link arm 1010, perforated bar 1015, bolt 1140, locking spring loaded plunger 515, L-link stud 1150, and arc of plunger location holes 1255.

Figure 13:
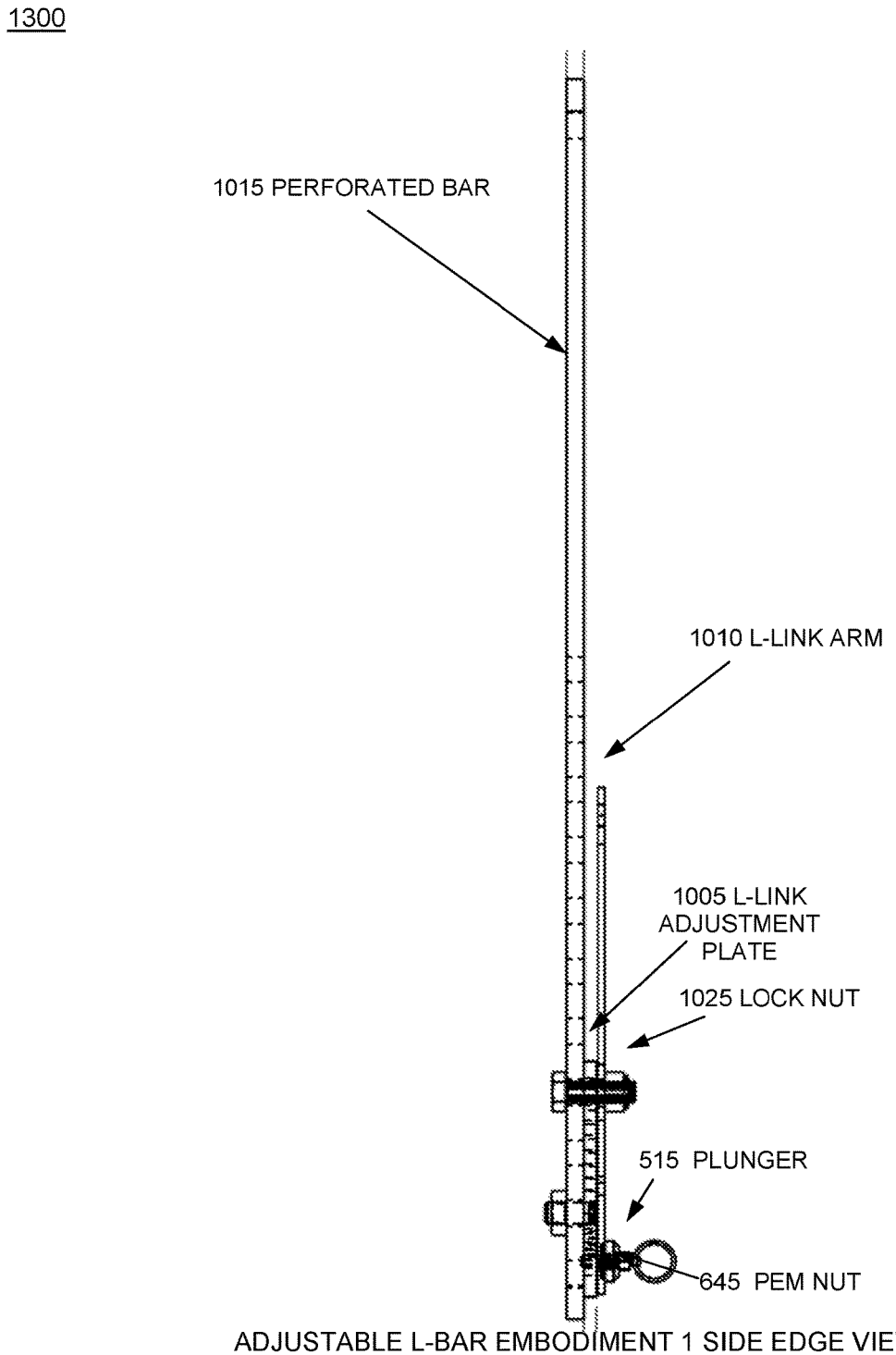
FIG. 13 is an adjustable L-link device scale side edge view configured in accordance with an embodiment.

FIG. 13 is an adjustable L-link device first embodiment side edge scale view 1300. Components comprise L-link adjustment plate 1005, L-link arm 1010, perforated bar 1015, first lock nut 1025, PEM® self-clinching threaded nut 645, and locking spring loaded plunger 515.

Figure 14:
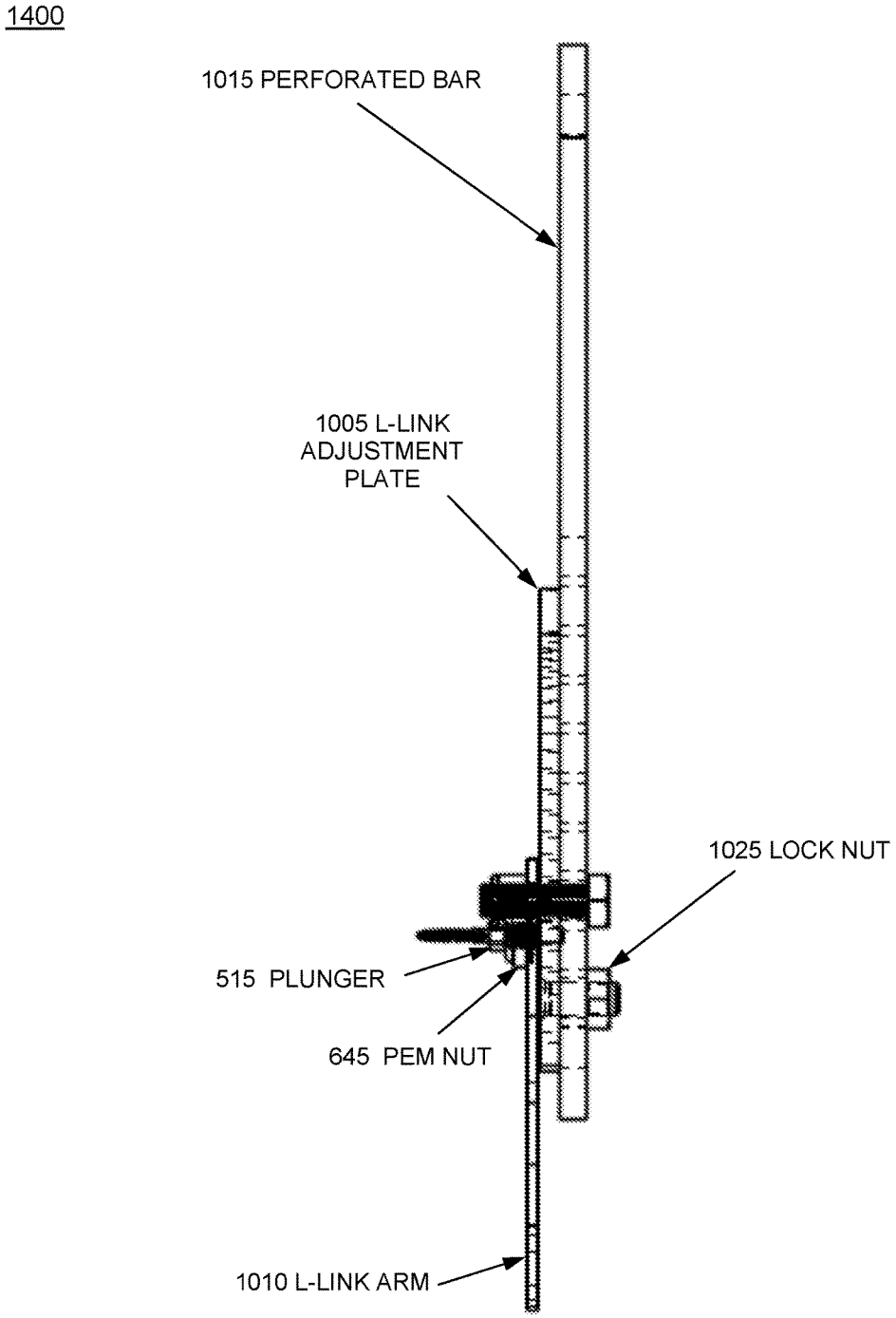
FIG. 14 is an adjustable L-link device bottom up scale view configured in accordance with an embodiment.

FIG. 14 is an adjustable L-link device first embodiment bottom up scale view 1400. Components comprise L-link adjustment plate 1005, L-link arm 1210, perforated bar 1015, first lock nut 1025, PEM® self-clinching threaded nut 645, and locking spring loaded plunger 515.

Figure 15:
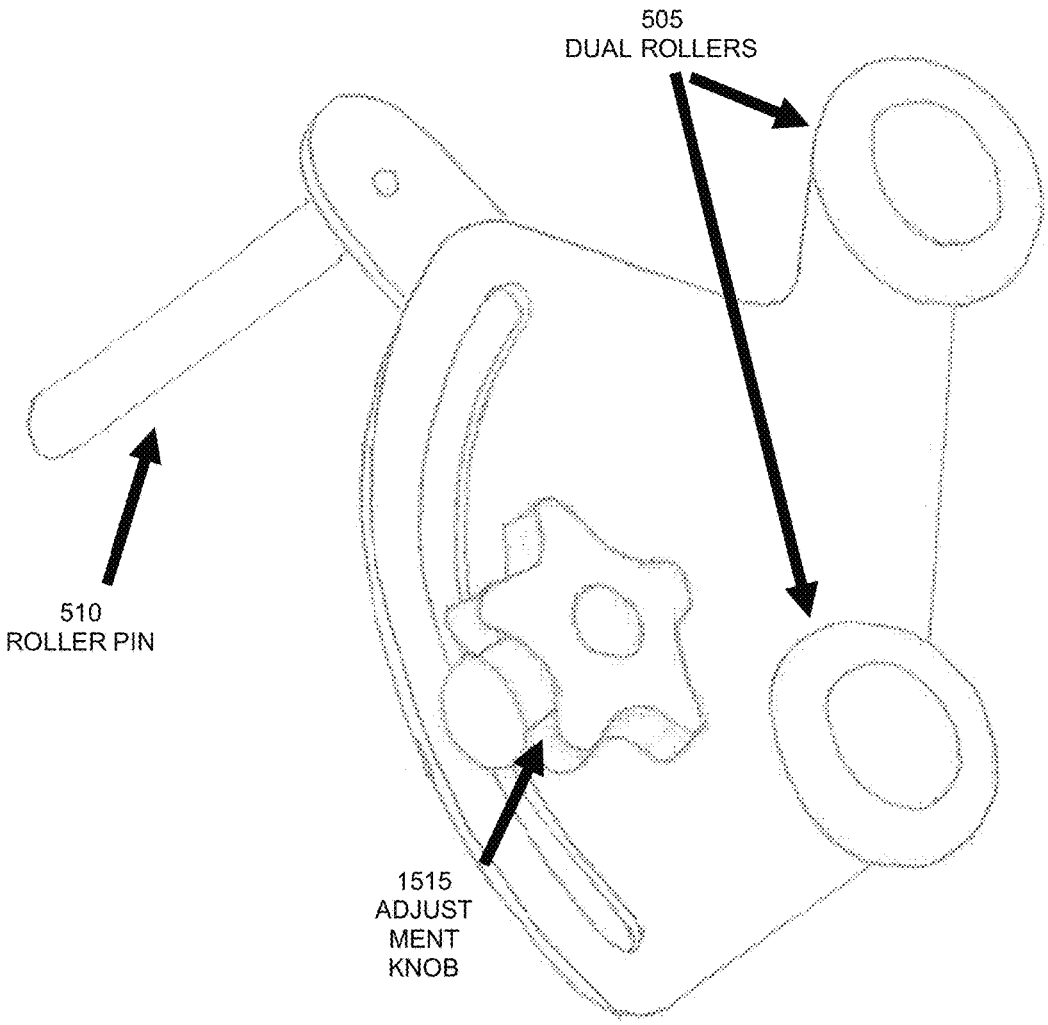
FIG. 15 is a perspective scale view of a top fixture adjustable roller device in a closed position configured in accordance with another embodiment.

FIG. 15 is a perspective view of a second embodiment 1500 for top fixture adjustable roller device. Components comprise dual rollers 505, roller pin 510, and adjustment knob 1515.

Figure 16:
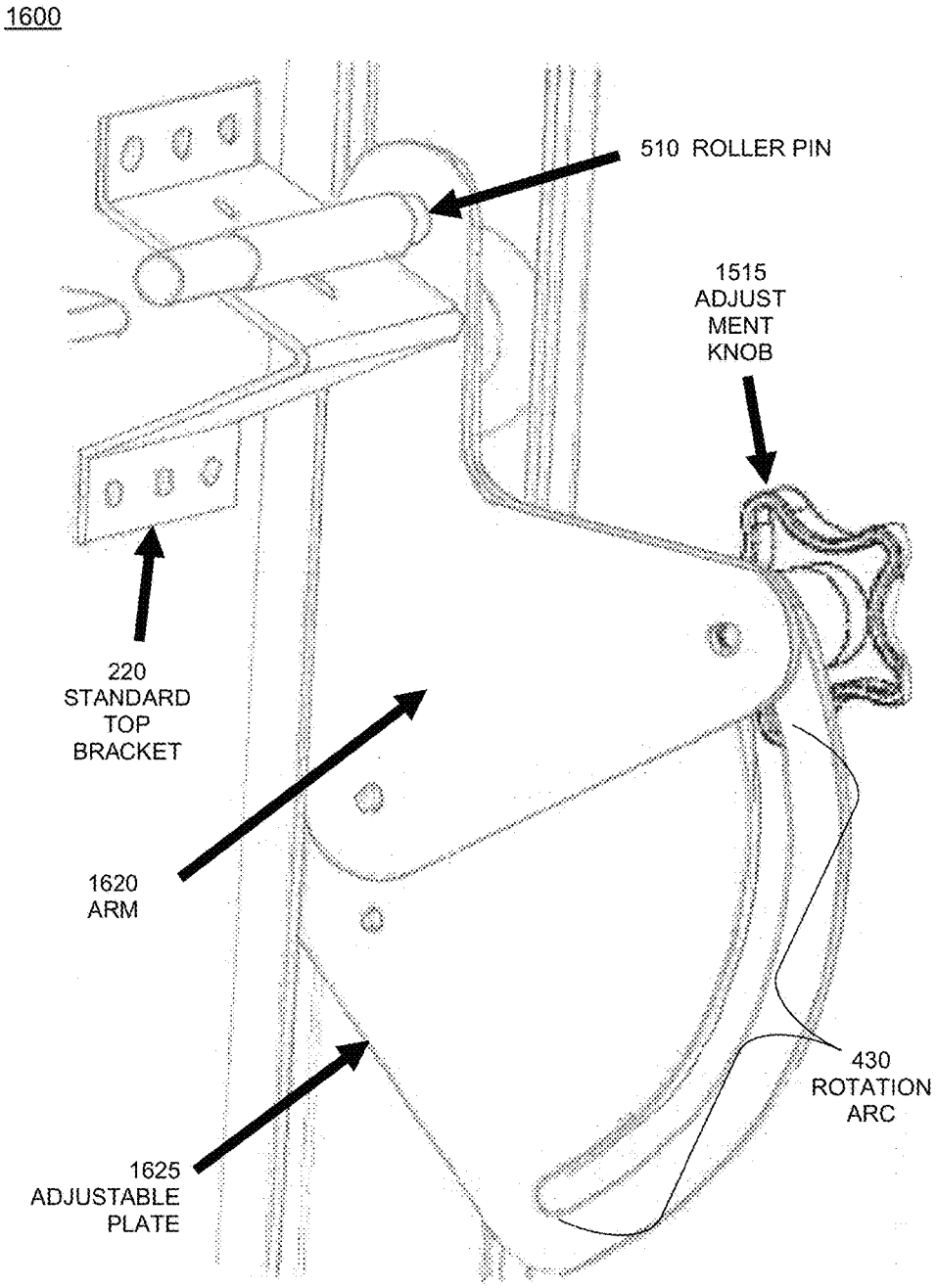
FIG. 16 is a perspective scale view of a top fixture adjustable roller device in a closed position configured in accordance with an embodiment.

FIG. 16 is a perspective scale drawing of a top fixture adjustable roller device second embodiment 1600. Components comprise roller pin 510, adjustment knob 1515, arm 1620, adjustable plate 1625, rotation arc 430, and standard top bracket 220.

Figure 17:
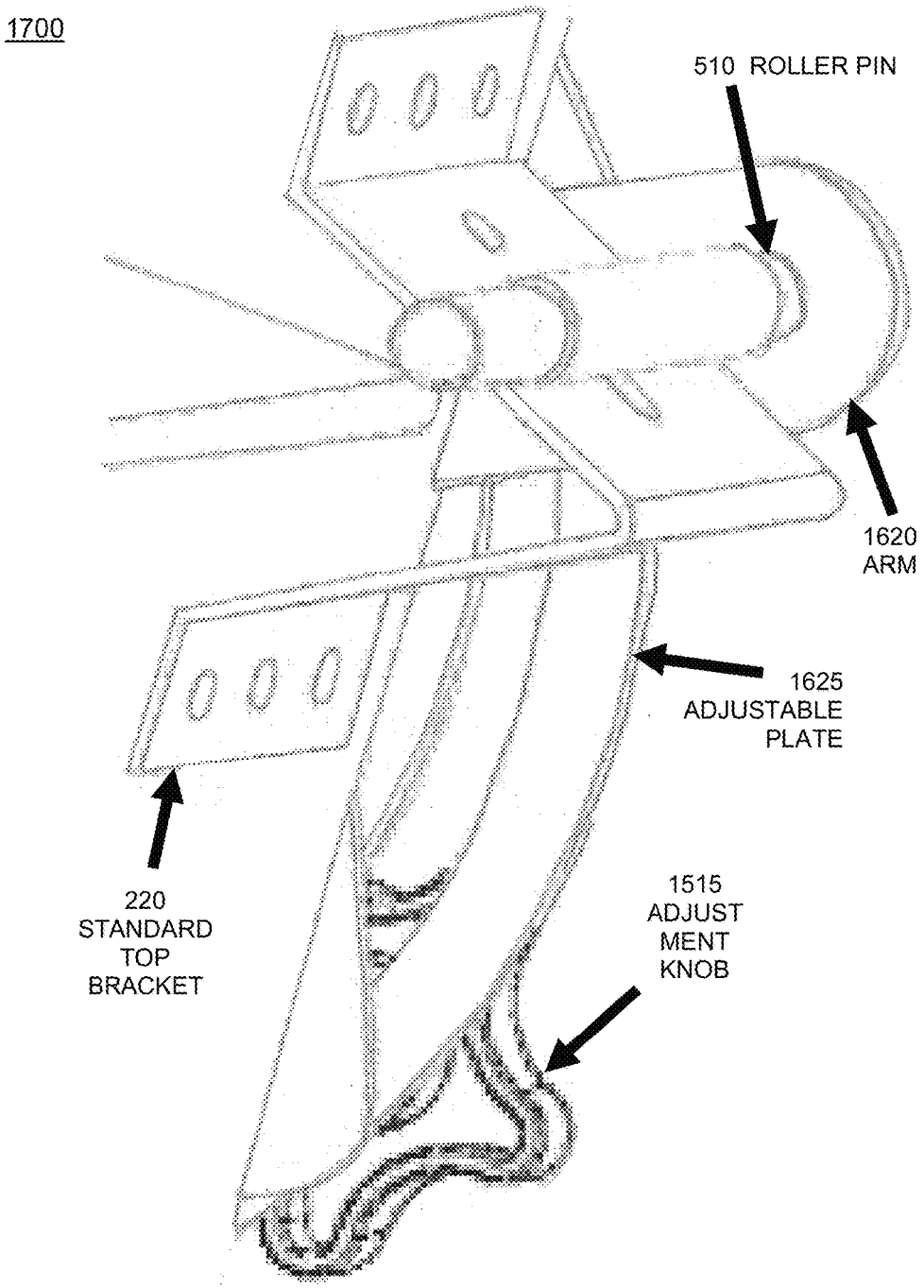
FIG. 17 is a perspective view of a top fixture adjustable roller device in an open position configured in accordance with an embodiment.

FIG. 17 is another perspective scale drawing of a top fixture adjustable roller device second embodiment 1700. Components comprise roller pin 510, adjustment knob 1515, arm 1610, adjustable plate 1625, and standard top bracket 220.

Figure 18:
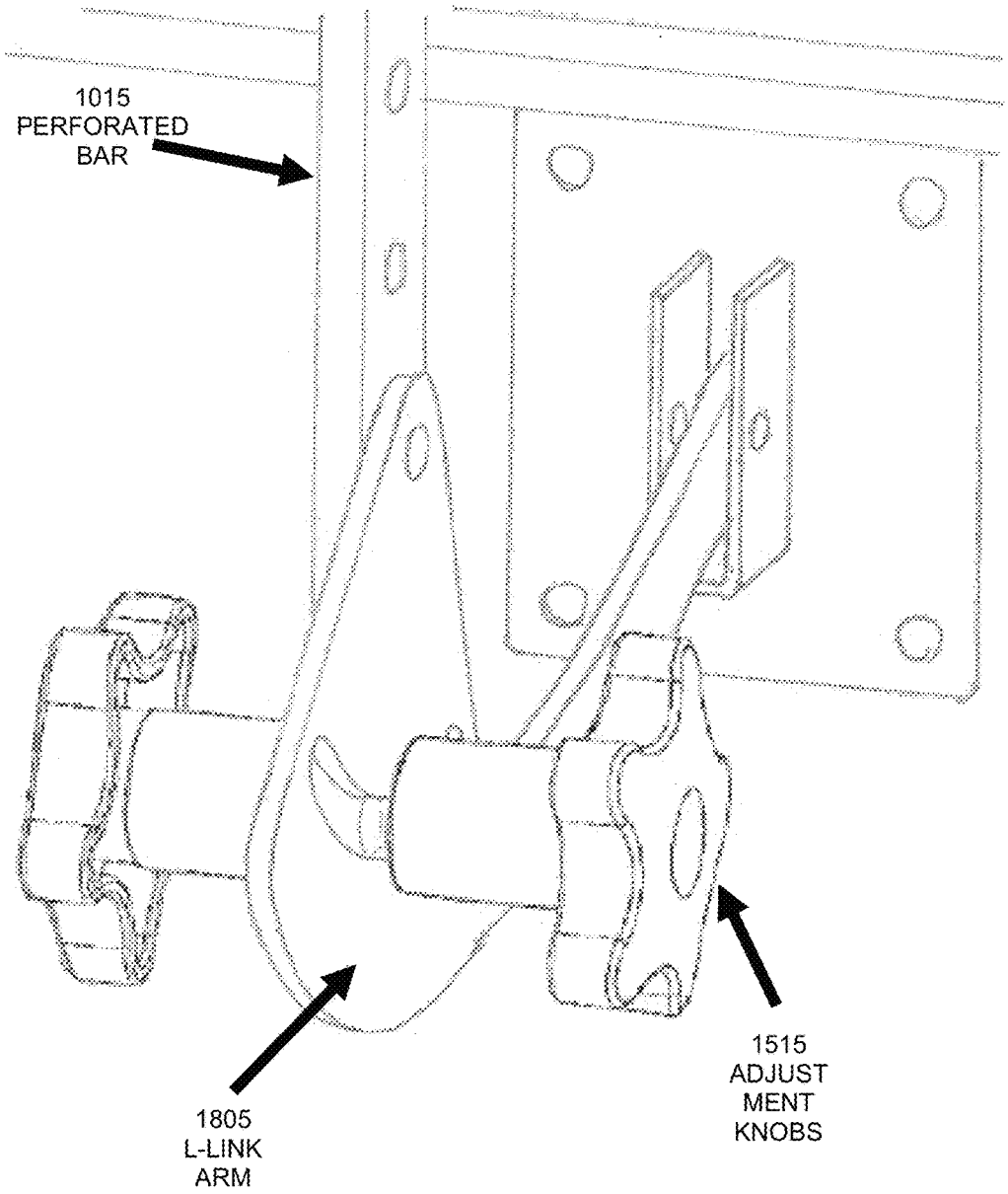
FIG. 18 is an adjustable L-link device perspective view configured in accordance with another embodiment.

FIG. 18 is a perspective view of an adjustable L-link device second embodiment 1800. Components comprise L-link arm 1805, perforated bar 1015, and adjustment knobs 1515.

Figure 19:
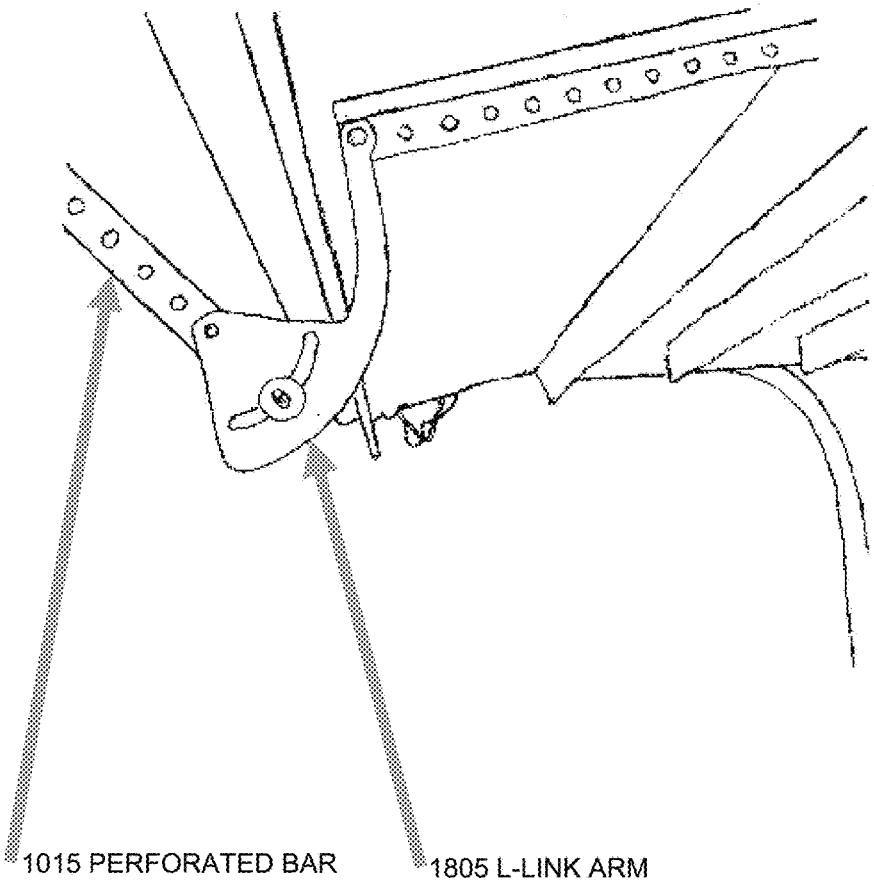
FIG. 19 is a view of an L-link device with door in open and raised position configured in accordance with another embodiment.

FIG. 19 is a perspective view of an adjustable L-link device with raised door 1900. Components comprise L-link arm 1805 and perforated bar 1015.

Figure 20:
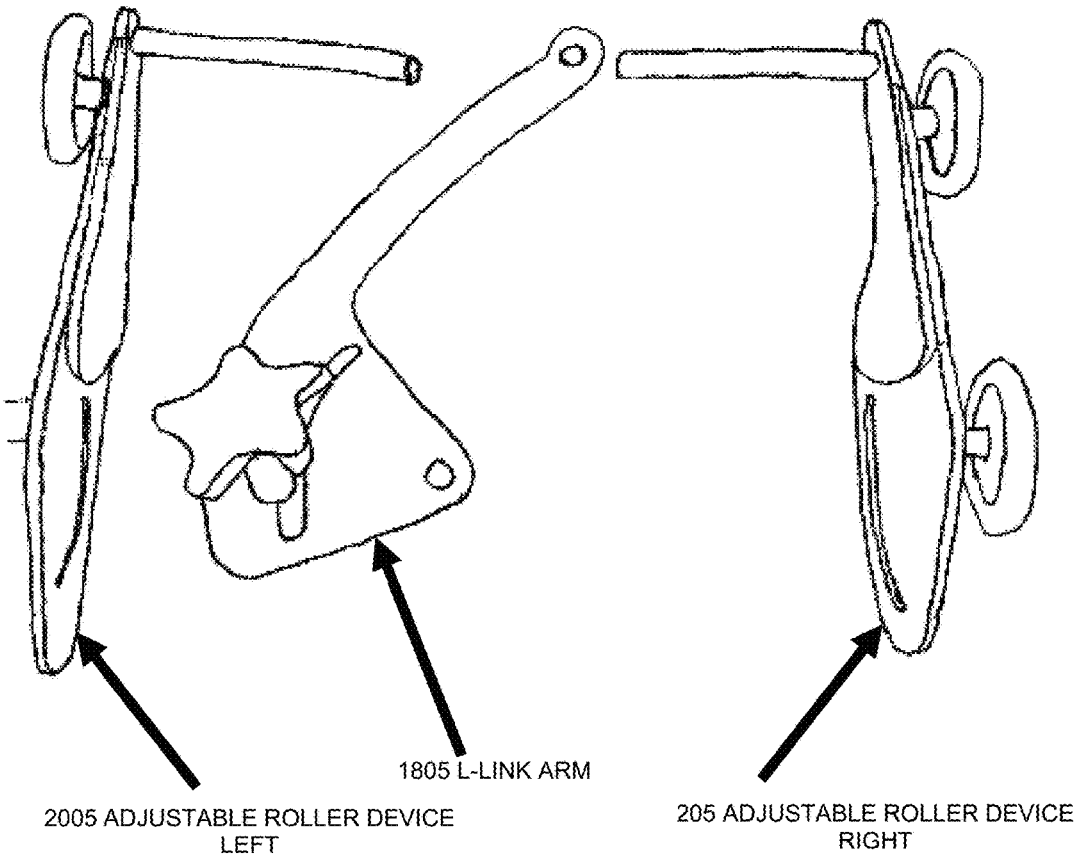
FIG. 20 is a view of adjustable roller devices and L-link device configured in accordance with another embodiment.

FIG. 20 is a perspective view of second embodiments 2000 for top fixture adjustable roller device and an adjustable L-link device. Components comprise left side top fixture adjustable roller device 2005, right side top fixture adjustable roller device 210, and adjustable L-link arm device 1805.

Figure 21:
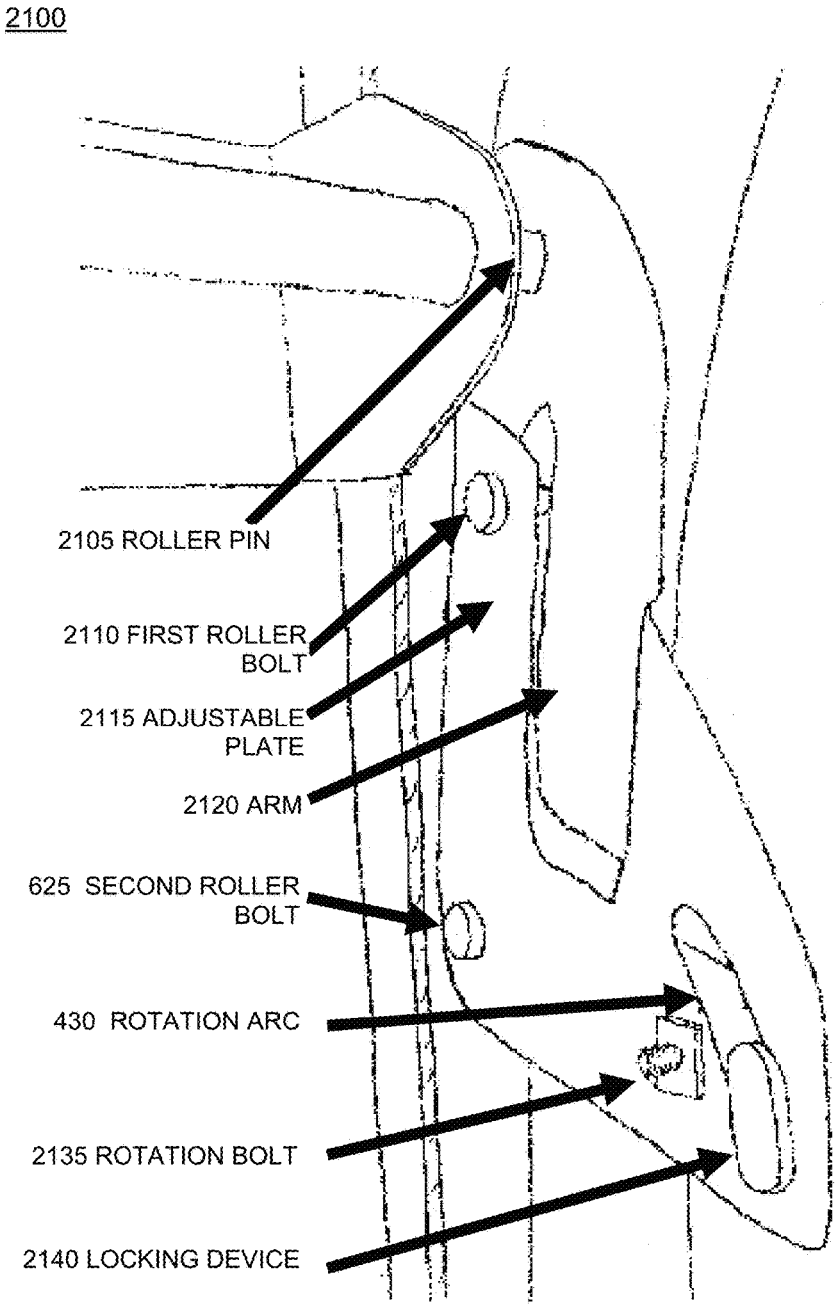
FIG. 21 is a perspective view of a top fixture adjustable roller device in a closed position configured in accordance with a third embodiment.

FIG. 21 is a perspective view of a third embodiment top fixture adjustable roller device 2100. Components comprise roller pin 2105, first roller bolt 2110, adjustable plate 2115, arm 2120, second roller bolt 625, rotation arc 430, rotation bolt 2135, and locking device 2140.

Figure 22:
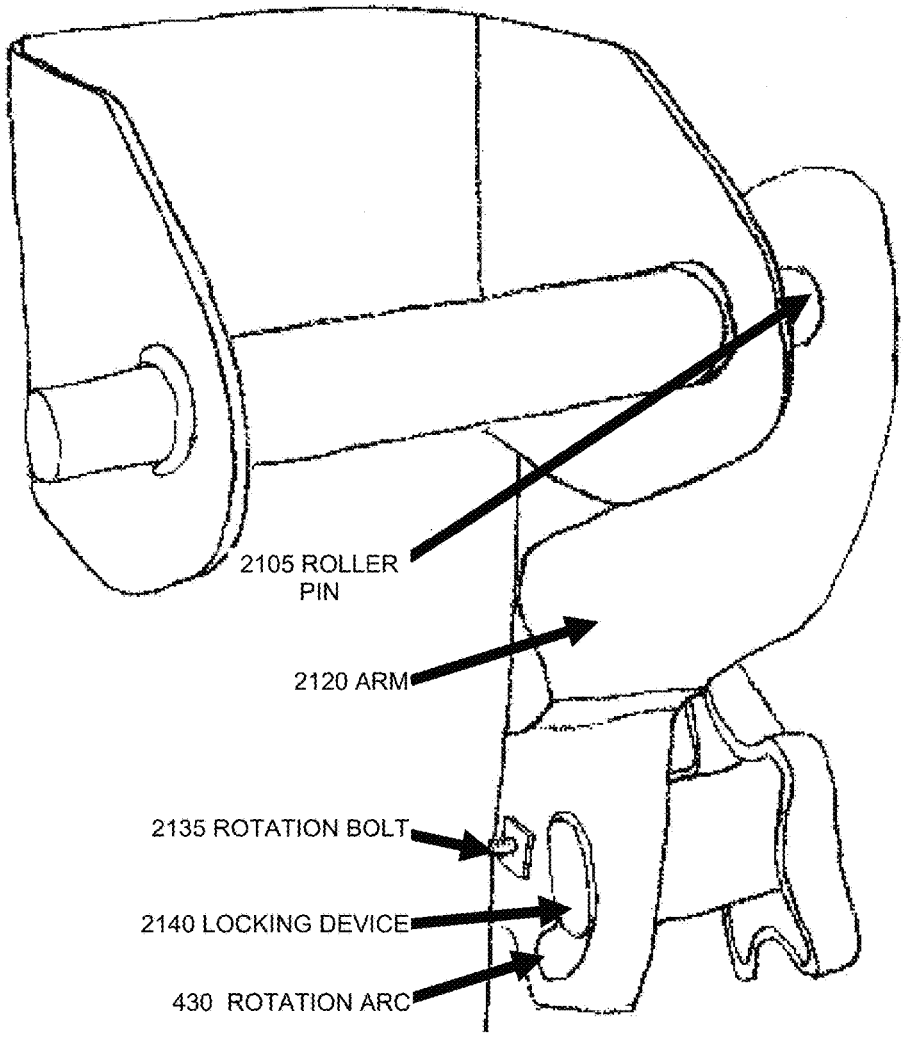
FIG. 22 is a perspective view of a top fixture adjustable roller device in an open position configured in accordance with a third embodiment.

FIG. 22 is a perspective view of a third embodiment top fixture adjustable roller device with door in open position 2200. Components comprise roller pin 2105, arm 2120, rotation bolt 2135, rotation arc 430, and locking device 2140.

Figure 23:
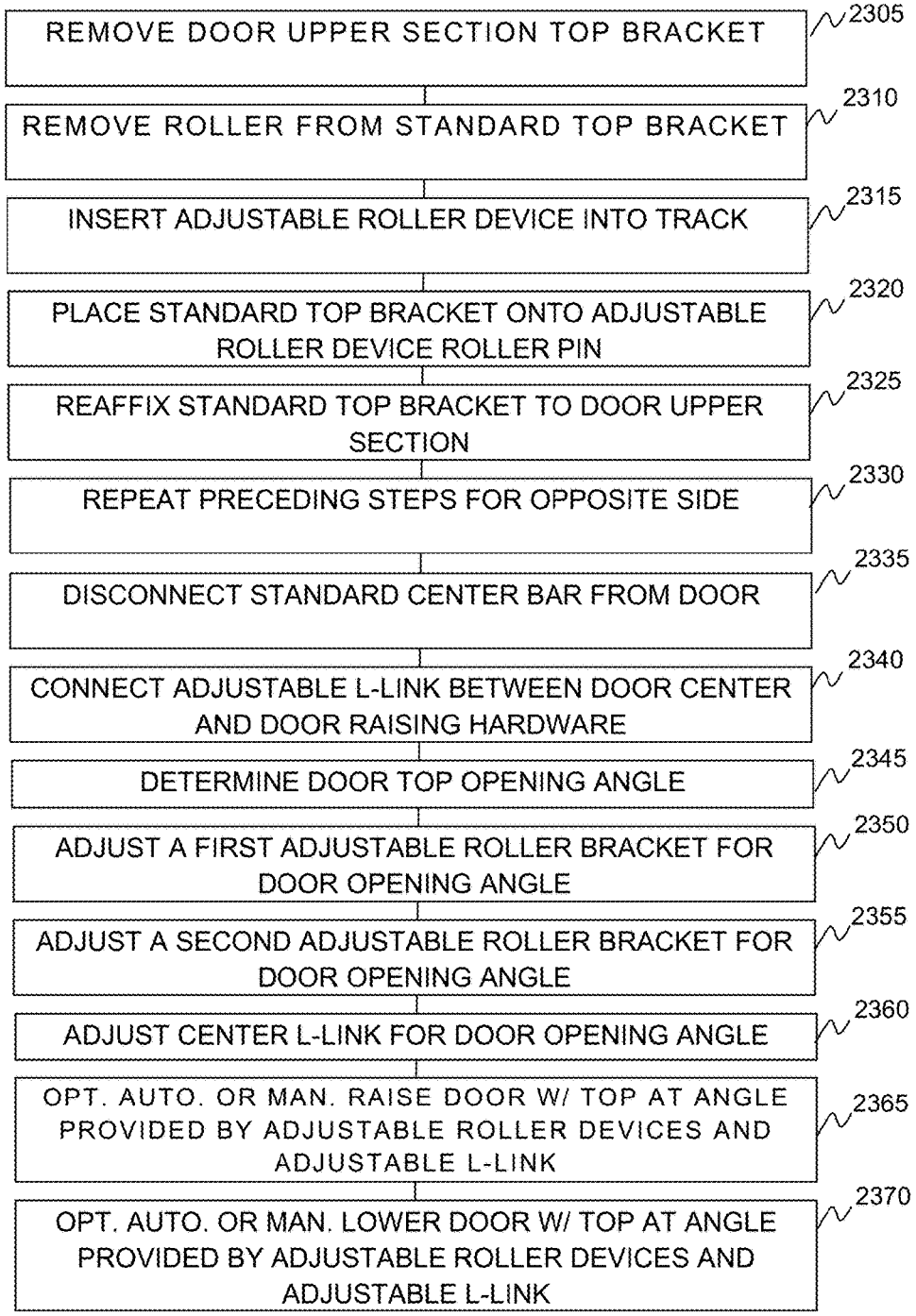
FIG. 23 is a flow chart of a method configured in accordance with an embodiment.

FIG. 23 is a method of operation for an embodiment 2300. Steps comprise removing door upper section top bracket 2305, removing roller from standard top bracket 2310, inserting adjustable roller device into track 2315, placing standard top bracket onto adjustable roller device roller pin 2320, reaffixing standard top bracket to door upper section 2325, repeating preceding steps for opposite side 2330, disconnecting standard center bar from door 2335, connect adjustable L-link between door center and door raising hardware 2340, determine door top opening angle 2345, adjust a first adjustable roller bracket for door opening angle 2350, adjust a second adjustable roller bracket for door opening angle 2355, adjust center L-link for door opening angle 2360, optionally automatically or manually raise door with door top at any angle provided by adjustable roller devices and adjustable L-link 2365, optionally automatically or manually close door with door top at any angle provided by adjustable roller devices and adjustable L-link 2370.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A door vent device for venting a space having at least one opening closed by a horizontally sectioned, vertically openable door, said door comprising a top section hingedly connected to lower sections, said vent device comprising:
- two adjustable roller device top fixtures (205, 2005);
- each of said two adjustable roller device top fixtures (205, 2005) comprising:
  - an axle roller pin (215, 510) for insertion in a top bracket (220) of said door top section (110);
  - a pair of adjustable roller device top fixture rollers (505);
  - a body plate (605, 1625);
  - a rotating arm plate (610, 1620), and
  - a rotation stop mechanism (1515);
- wherein:
  - said axle roller pin (215, 510) is not directly connected to either of said adjustable roller device top fixture rollers (505), but is directly mounted to said rotating arm plate (610, 1620);
  - said adjustable roller device top fixture rollers are directly mounted to the body plate; and
  - the rotating arm plate, the axle roller pin, and the top bracket of each adjustable roller device top fixtures are configured to rotate relative to each corresponding body plate while said body plate and the respective adjustable roller device top fixture rollers are rotationally fixed relative to the track;
- whereby said door top section (110) is rotatable inward.

2. The device of claim 1 further comprising an adjustable L-link device (1805) capable of being attached to a door arm bracket.

3. The device of claim 1 wherein said rotation stop mechanism (1515) further comprises at least one rotation stop mechanism knob (1515).

4. The device of claim 1 further comprising a locking spring-loaded plunger (515).

5. The device of claim 1 wherein a width of said body plate (605, 1625) and said rotating arm plate (610, 1620) of said adjustable roller device top fixture (205, 2005) is less than a horizontal separation between a door-side edge of a track and a track-side edge of nearest said top bracket (220) of said door top section (110).

6. The device of claim 5 wherein said horizontal separation is about one half inch.

7. The device of claim 1 wherein said body plate defines a rotation arc.

8. The device of claim 7 wherein said rotation arc intersects an arc defined by a rotation radius of said door top section.

9. The device of claim 7 wherein said rotation arc is defined by a radius from center of a lower roller (620) of said pair of adjustable roller device top fixture rollers (520) as oriented with said door in a closed position (320).

10. The device of claim 7 wherein radius of said rotation arc is centered at a pivot of said rotating arm plate (610, 1620).

11. The device of claim 2 wherein said adjustable L-link device (1805) connects to a center automatic door opener.

12. The device of claim 11 wherein said door can be opened and closed by said automatic door opener with door top at any venting position.

13. The device of claim 1 further comprising at least one swage fit stud (510).

14. The device of claim 1 further comprising at least one swage fit bolt (645).

15. A door vent product for venting a space having at least one opening closed by a horizontally sectioned, vertically openable door, said door comprising a top section hingedly connected to lower sections, said door vent product comprising:
- a vent device comprising:
  - at least two adjustable roller device top fixtures (205, 2005); each of said adjustable roller device top fixtures comprising:
    - an axle roller pin (215, 510) for insertion in a top bracket (220) of said door top section (110);
    - a pair of adjustable roller device top fixture rollers (505);
    - a body plate (605, 1625);
    - a rotating arm plate (610, 1625); and
    - a rotation stop mechanism (1515);
  - an adjustable L-link (1805) between a door center and a door raising hardware;
- whereby the top section of the door is configured to have an opening angle;
- whereby a first of said adjustable roller device top fixtures (205, 2005) can be configured for said door opening angle;
- whereby a second of said adjustable roller device top fixtures (205, 2005) can be configured for said door opening angle;
- whereby said center L-link (1805) can be configured for said door opening angle;
- wherein:
  - said axle roller pin (215, 510) is not directly connected to either of said adjustable roller device top fixture rollers (505), but is directly mounted to said rotating arm plate (610, 1620);
  - said adjustable roller device top fixture rollers are directly mounted to the body plate; and the rotating arm plate, the axle roller pin, and the top bracket of each adjustable roller device top fixtures are configured to rotate relative to each corresponding body plate while said body plate and the respective adjustable roller device top fixture rollers are rotationally fixed relative to the track;

whereby said door top section (110) is rotatable inward and said door can be raised with said door top section (110) at any angle provided by said adjustable roller devices (205, 2005) and said adjustable L-link (1805).

* * * * *